US007591565B2

(12) United States Patent
Chadha

(10) Patent No.: US 7,591,565 B2
(45) Date of Patent: Sep. 22, 2009

(54) DISPLAY DEVICE FOR CREATING A BACKLIT EFFECT ON A DISPLAY ARTICLE

(76) Inventor: Ajay Chadha, 1601 Applewood Way, Tallahassee, FL (US) 32312

( * ) Notice: Subject to any disclaimer, the term of this patent is extended or adjusted under 35 U.S.C. 154(b) by 0 days.

(21) Appl. No.: 12/321,169

(22) Filed: Jan. 20, 2009

(65) Prior Publication Data

US 2009/0129066 A1 May 21, 2009

Related U.S. Application Data

(63) Continuation-in-part of application No. 11/881,606, filed on Jul. 27, 2007, now abandoned.

(51) Int. Cl.
*F21V 35/00* (2006.01)
*F21V 33/00* (2006.01)

(52) U.S. Cl. ..... 362/161; 362/280; 362/355; 362/97.1; 362/360; 40/367; 40/799; 40/714; 40/716

(58) Field of Classification Search ..... 362/97.1, 362/97.4, 161, 166–169, 277, 319, 280, 281, 362/363, 806, 812, 253, 351, 355, 356, 360, 362/367; 40/790, 791, 798, 799, 361, 367, 40/714, 716; 431/253, 289
See application file for complete search history.

(56) References Cited

U.S. PATENT DOCUMENTS 1,585,765 A 5/1926 Chitra
1,660,760 A * 2/1928 Murphy ..... 40/541
3,416,871 A * 12/1968 Dragan ..... 431/125
4,017,729 A 4/1977 Frazier, Jr.
4,940,301 A 7/1990 Sallai
5,264,995 A 11/1993 McKee
D421,656 S 3/2000 Batterman-Jordan
6,179,437 B1 * 1/2001 Hardy et al. ..... 362/162
6,554,447 B1 4/2003 Kotary et al.
6,736,530 B2 * 5/2004 Thevenot ..... 362/362
6,821,002 B1 * 11/2004 Morgen ..... 362/351
6,920,711 B2 7/2005 Miller et al.
7,171,772 B1 2/2007 Male
7,314,293 B2 * 1/2008 Steier et al. ..... 362/351
2004/0130899 A1 * 7/2004 Skouras et al. ..... 362/351
2005/0007754 A1 1/2005 Creel
2008/0094825 A1 * 4/2008 Silver ..... 362/161

* cited by examiner

*Primary Examiner*—Thomas M Sember
(74) *Attorney, Agent, or Firm*—J. Wiley Horton

(57) ABSTRACT

A display device for creating a backlit effect on a display article—such as a photograph—with a candle. The display device includes a candle container and a display panel attached to the wall of the candle container by a stand-off. The wall of the candle, display panel, and stand-off together form a pocket for receiving a sleeve which receives a display article. Both the display panel, inside wall and sleeve allow the light of the candle to transmit through the display device and create a backlit effect on the display article that is viewable through the display panel.

21 Claims, 12 Drawing Sheets

DISPLAY DEVICE FOR CREATING A BACKLIT EFFECT ON A DISPLAY ARTICLE

CROSS-REFERENCES TO RELATED APPLICATIONS

This non-provisional application is a continuation-in-part of U.S. patent application Ser. No. 11/881,606 (filed on Jul. 27, 2007) now abandoned. The two applications list the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of decorative candleholders and display devices. More specifically, the invention comprises a candle container configured to provide ambient backlighting for a user-selectable display article such as a picture.

2. Description of the Related Art

Various decorative candleholders that utilize a candle light source to illuminate a display article (such as a picture) are known in the prior art. Each of these prior art display devices use different illumination techniques to achieve a unique visual effect. Despite the existence of these types of devices there remains a need for a picture display device which is capable of imparting greater warmth and animation to a user-selected picture. It is also desirable for the device to be configured such that the user may easily change the picture displayed in the device from time to time. It is further desirable that such a display device be easy and cost-effective to manufacture and ship.

BRIEF SUMMARY OF THE INVENTION

The present invention comprises a display device for creating a backlit effect on a display article—such as a photograph—with a candle. The display device includes a candle container, a display panel attached to the wall of the candle container by a stand-off creating a pocket. A sleeve fits into the pocket. The pocket is formed between the inside wall of the candle, display panel, and stand-off. The pocket receives the sleeve which receives the display article. The sleeve, display panel, and inside wall allow the light of the candle to transmit through the display device and create a backlit effect on the display article that is viewable through the display panel.

Figure 1:
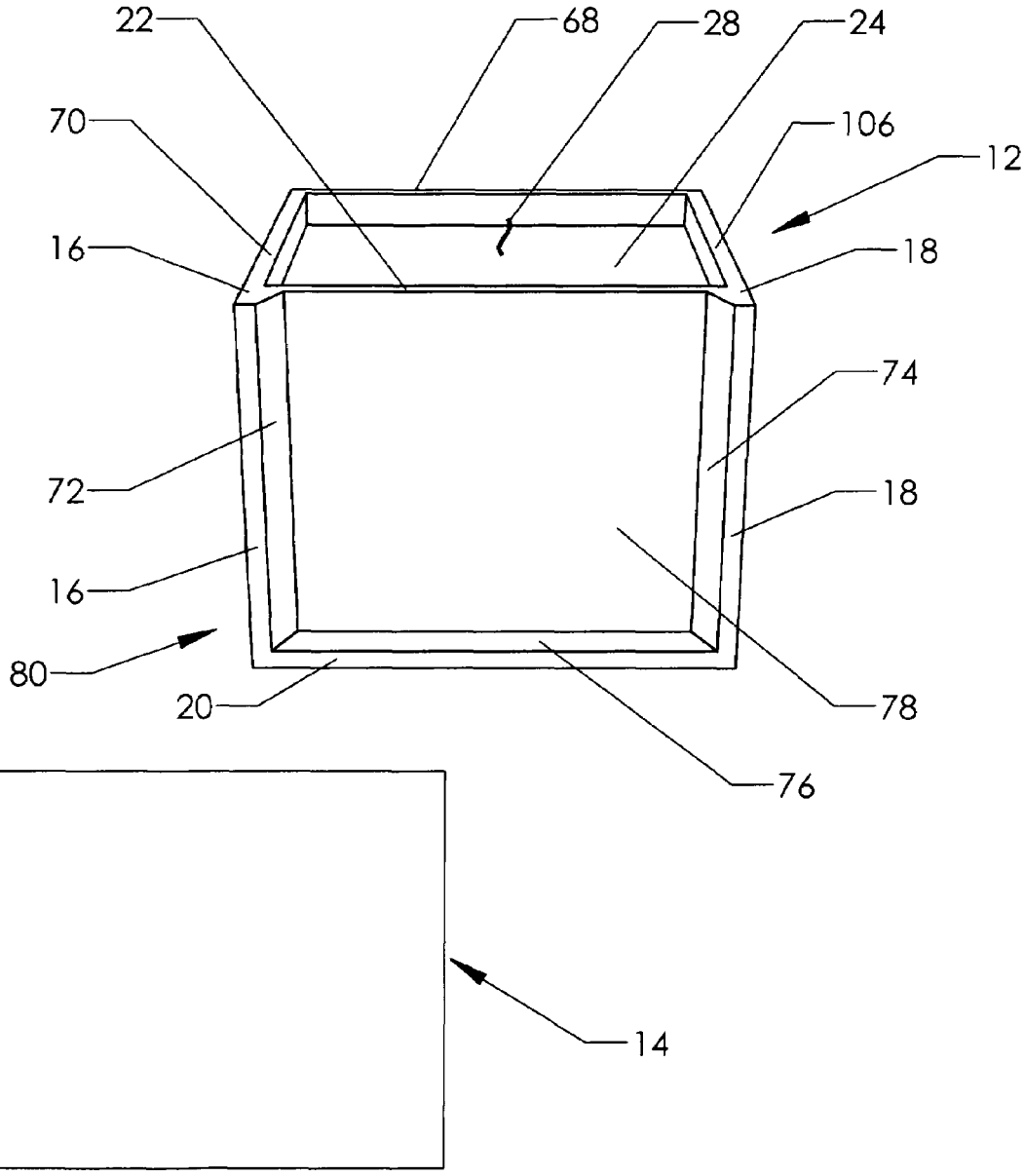
FIG. 1 is a perspective view, showing the present invention.

| REFERENCE NUMERALS IN THE DRAWINGS | |
|---|---|
| 10 | display device |
| 14 | display panel |
| 18 | spacer |
| 22 | inside wall |
| 30 | picture |
| 34 | mounting studs |
| 38 | spacer |
| 42 | display panel |
| 46 | spacer |
| 50 | mounting bores |
| 54 | advertisement |
| 58 | matrix |
| 62 | sleeve |
| 66 | inner sleeve area |
| 70 | first side wall |
| 74 | second interior wall |
| 78 | inside wall face |
| 82 | front cover |
| 86 | tab |
| 90 | second sleeve |
| 94 | second inside wall |
| 98 | back cover |
| 102 | sleeve |
| 106 | second side wall |
| 12 | candle container |
| 16 | spacer |
| 20 | spacer |
| 24 | candle |
| 28 | wick |
| 32 | mounting bores |
| 36 | spacer |
| 40 | picture |
| 44 | pocket |
| 48 | spacer |
| 52 | mounting studs |
| 56 | wall |
| 60 | inner container |
| 64 | first fold |
| 68 | back wall |
| 70 | first interior wall |
| 76 | third interior wall |
| 80 | stand-off |
| 84 | back cover |
| 88 | notch |
| 92 | second fold |
| 96 | front cover |
| 100 | first fold |
| 104 | inner sleeve area |

DETAILED DESCRIPTION OF THE INVENTION

The present invention, including candle container 12 and display panel 14, is illustrated in FIG. 1. In the preferred embodiment candle container 12 has four walls, first side wall 70, second side wall 106, back wall 68 and inside wall 22. Candle container 12 surrounds candle 24 which has wick 28. Candle 24 may be made of various hydrocarbon materials including waxes or gels. It is preferred that candle 24 be made of a clear material, however, as will be described in greater detail subsequently. In the current embodiment, candle 24 is a rectangular block of material, but candle 24 may assume many shapes. Candle container 12 is generally rectangular in shape (having a square cross-section), having four walls and a base, although candle container 12 may assume many different shapes and have various number(s) of walls. Spacers 16, 18, and 20 extend outwardly from a wall of candle container 12 annotated as inside wall 22. It is important that inside wall 22 be made of a clear or translucent material for reasons that will be explained in greater detail subsequently. Each spacer 16, 18, and 20 has a corresponding interior wall, first interior wall 72, second interior wall 74, and third interior wall 76, consecutively. Spacers 16, 18, and 20 and interior wall 72, 74, and 76 form a U-shaped stand-off 80. The reader will note that spacers 16, 18, and 20 are integrated with candle container 12. In the preferred embodiment, candle container 12 and spacers 16, 18, and 20 are made from a common piece of glass or clear plastic (such as polycarbonate). This optimizes the manufacturing process since attaching spacers 16, 18, and 20 to candle container 12 with adhesive or mechanical fasteners adds another stage and potential bottleneck in the manufacturing process. Display panel 14 is a separate component which is attached to spacers 16, 18, and 20 later in the manufacturing process.

Figure 2:
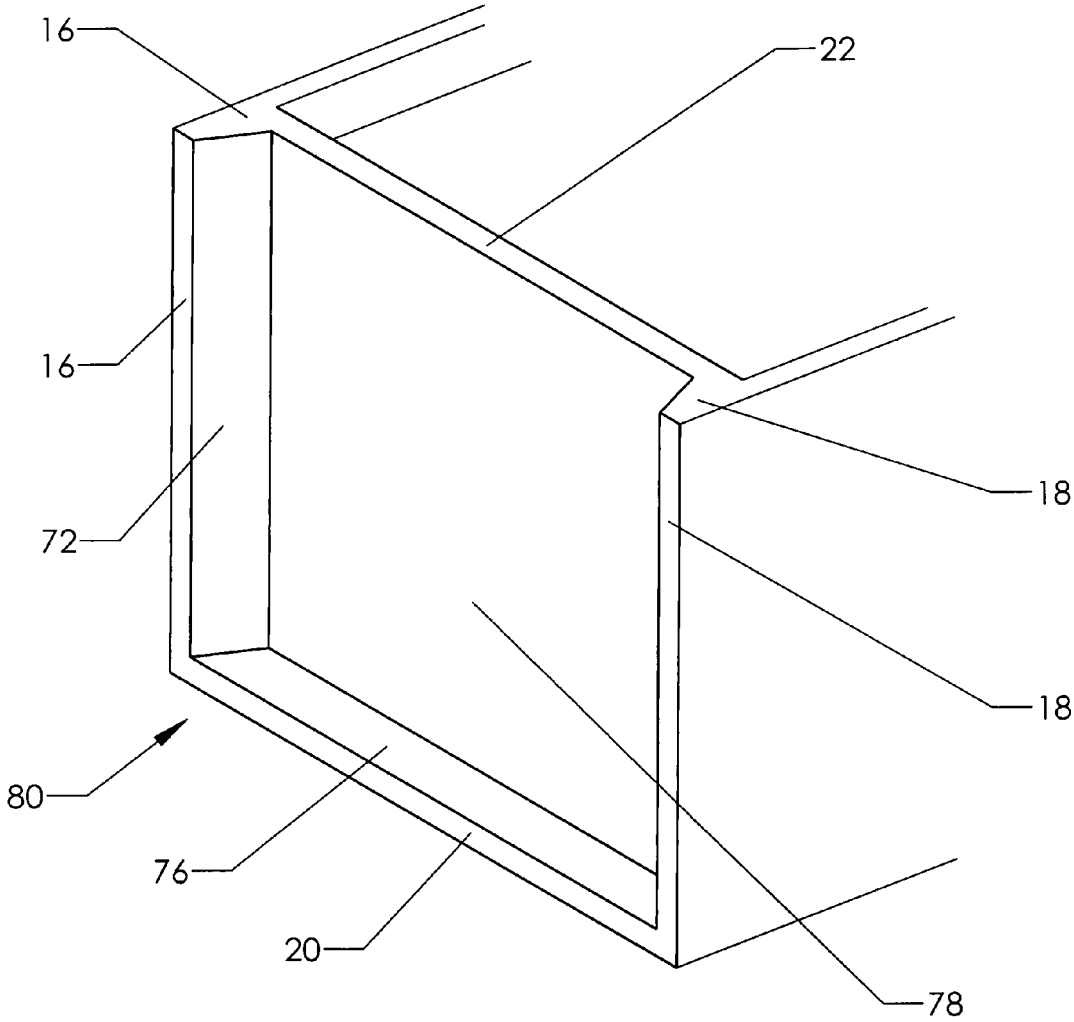
FIG. 2 is a perspective view, showing the stand-off and inside wall of the present invention.

FIG. 2 illustrates an exploded view of stand-off 80. As discussed previously, spacers 16, 18 and 20 are integrated with candle container 12 (shown in FIG. 1). In the preferred embodiment, first interior wall 72 of spacer 16 meets inside wall face 78 and inside wall 22 such that the angle between interior wall 72 and inside wall face 78 is obtuse.

Figure 3:
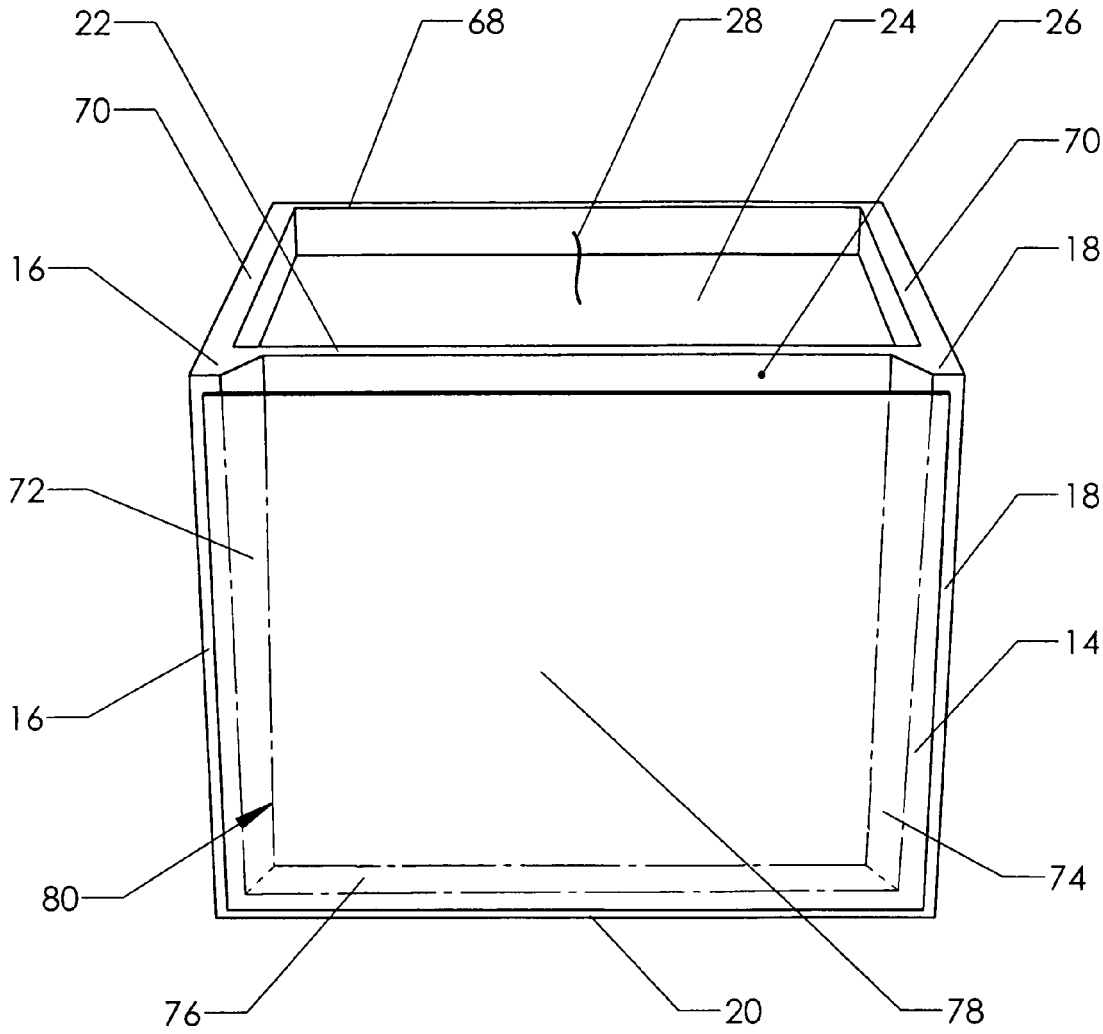
FIG. 3 is a perspective view, showing the present invention.

In the present embodiment, as shown in FIG. 3, display panel 14 is attached to spacers 16, 18, and 20 by a contact adhesive such as a glue or epoxy. When display panel 14 is attached to spacers 16, 18, and 20, stand-off 80 separates display panel 14 from inside wall 22 and inside wall face 78 forming pocket 26. Therefore pocket 26 is enclosed by display panel 14, inside wall face 78, first interior wall 72, second interior wall 74, and third interior wall 76. The top of pocket 26 is open for receiving a display article such as a picture or photograph.

Figure 4:
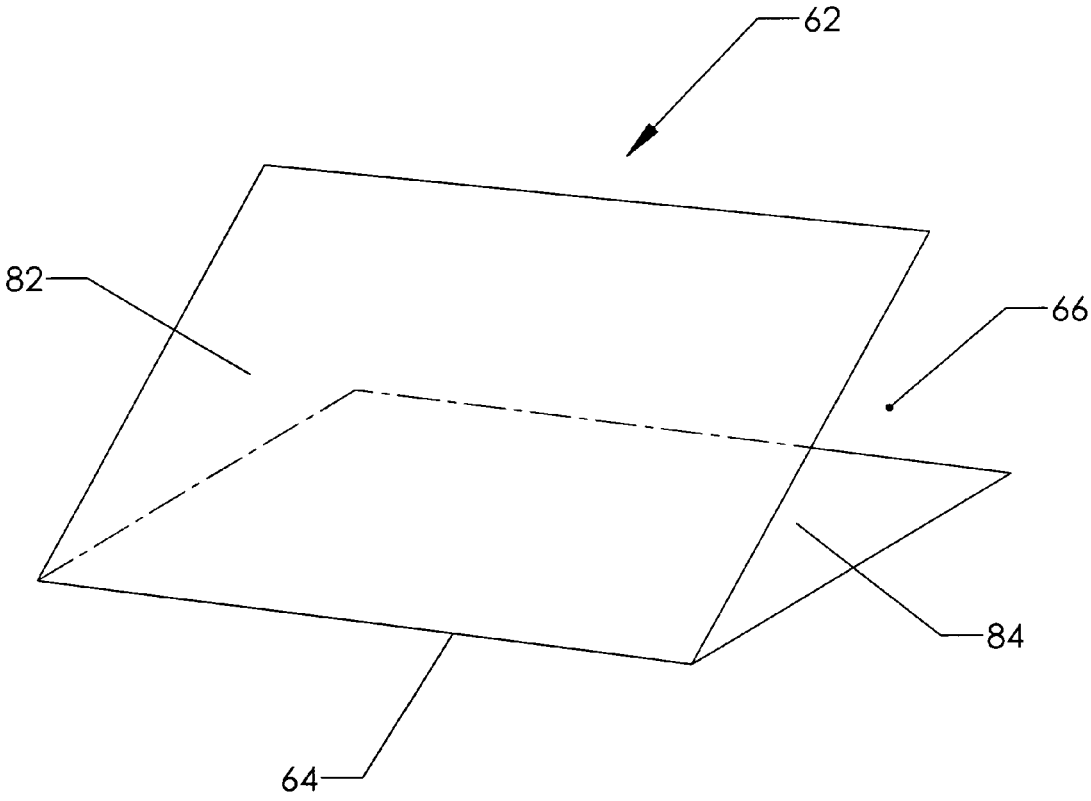
FIG. 4 is a perspective view, showing the sleeve of the present invention.

FIG. 4 illustrates sleeve 62. Sleeve 62 is formed by front cover 82 and back cover 84. Front cover 82 and back cover 84 meet at fold 64. Back cover 84 is shown partly in broken lines, because it is viewed through a transparent front cover 82. An inner sleeve area 66 is formed between front cover 82 and back cover 84. Inner sleeve area 66 can accept a display article such as a picture or photograph. Back cover 84 is preferably transparent or opaque and made of a material that allows light to pass through it.

Figure 5:
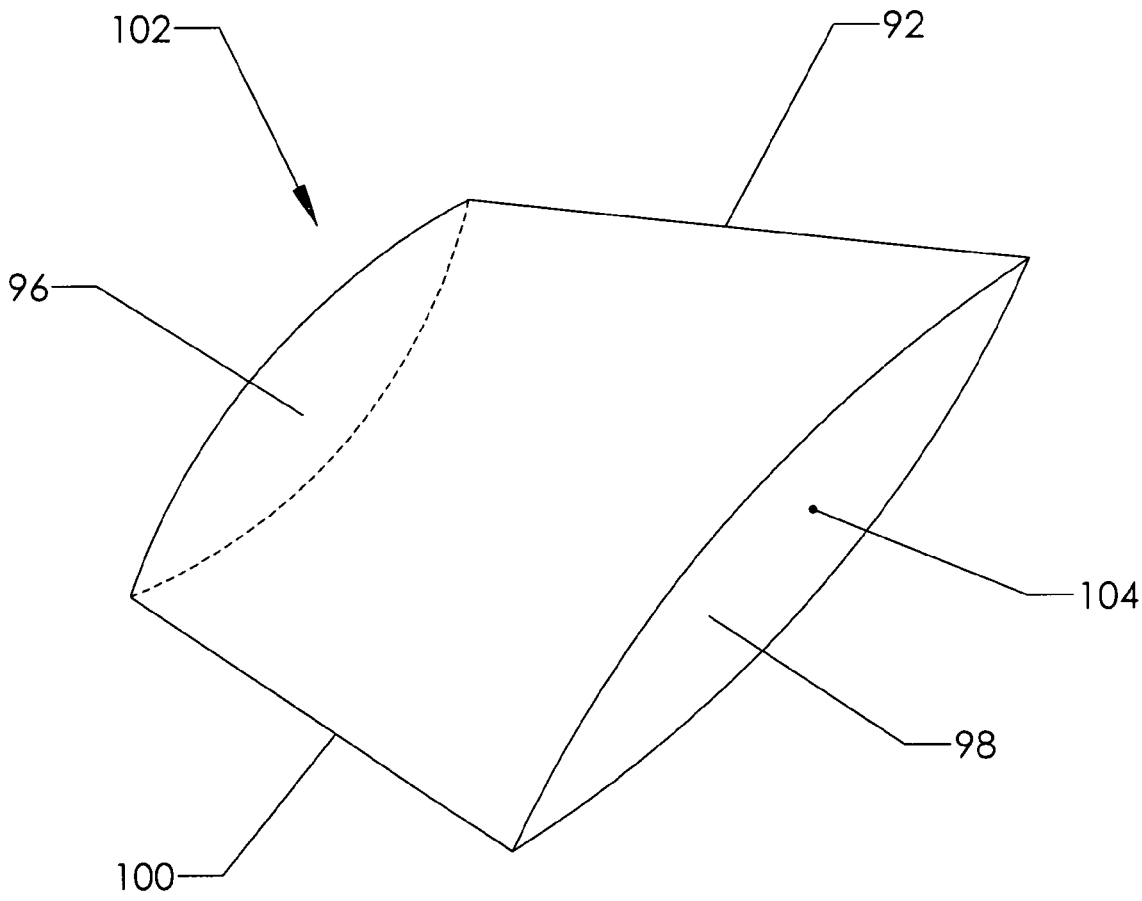
FIG. 5 is a perspective view, showing an alternate embodiment of the sleeve of the present invention.

An alternate embodiment of sleeve 102 of the present invention is shown in FIG. 5. Alternate sleeve 106 has a first fold 100 and a second fold 92 at opposing ends connecting front cover 96 to back cover 98. An inner sleeve area 104 is formed between front cover 96 and back cover 98. Inner sleeve area 104 can be accessed by applying pressure to both first fold 100 and second fold 92, bowing front cover 96 and back cover 98 away from one another. At rest, alternate sleeve 106 lies flat and can fit into pocket 26 (not shown).

Figure 6:
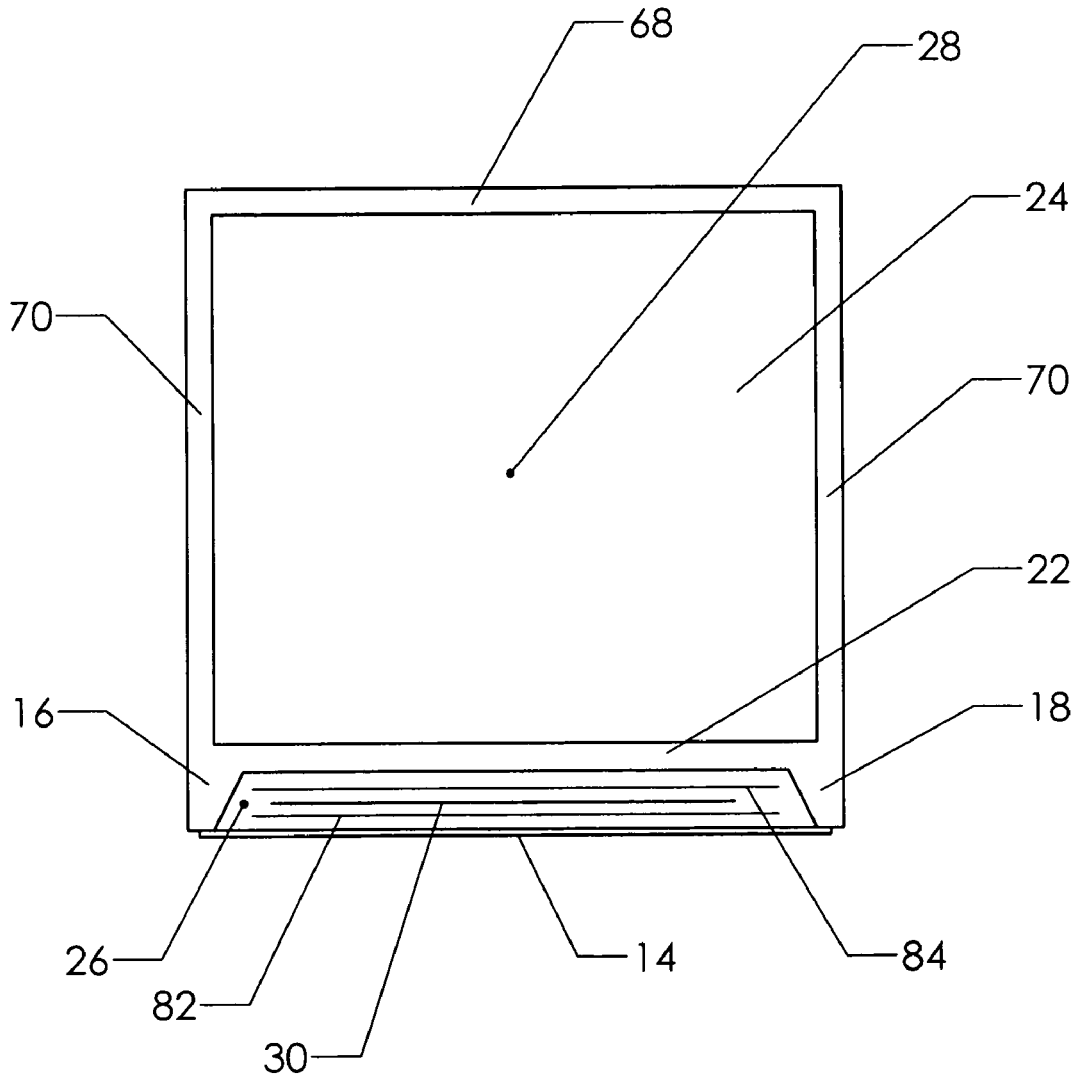
FIG. 6 is a top view, showing the present invention.

A top view of candle container 12 is provided in FIG. 6. The reader will note that picture 30 rests between front cover 82 and back cover 84 of sleeve 62. Sleeve 62 rests between display panel 14 and inside wall 22 in pocket 26. When wick 28 is lighted, candle light passes through inside wall 22 and back cover 84 striking the back of picture 30. This creates a backlit effect on the picture 30. The term "backlit effect" as used herein means any effect created on a display article when light from a light source strikes the display article on one side and the display article is viewed from the opposite side. The natural flickering and the orange light emitted by the burning candle, makes skin tones in photographs appear more lifelike and pictures appear more aesthetically pleasing. In the present embodiment, it is desirable for candle 24 to be made of a clear material so that candlelight can pass through candle 24 and inside wall 22.

Figure 7:
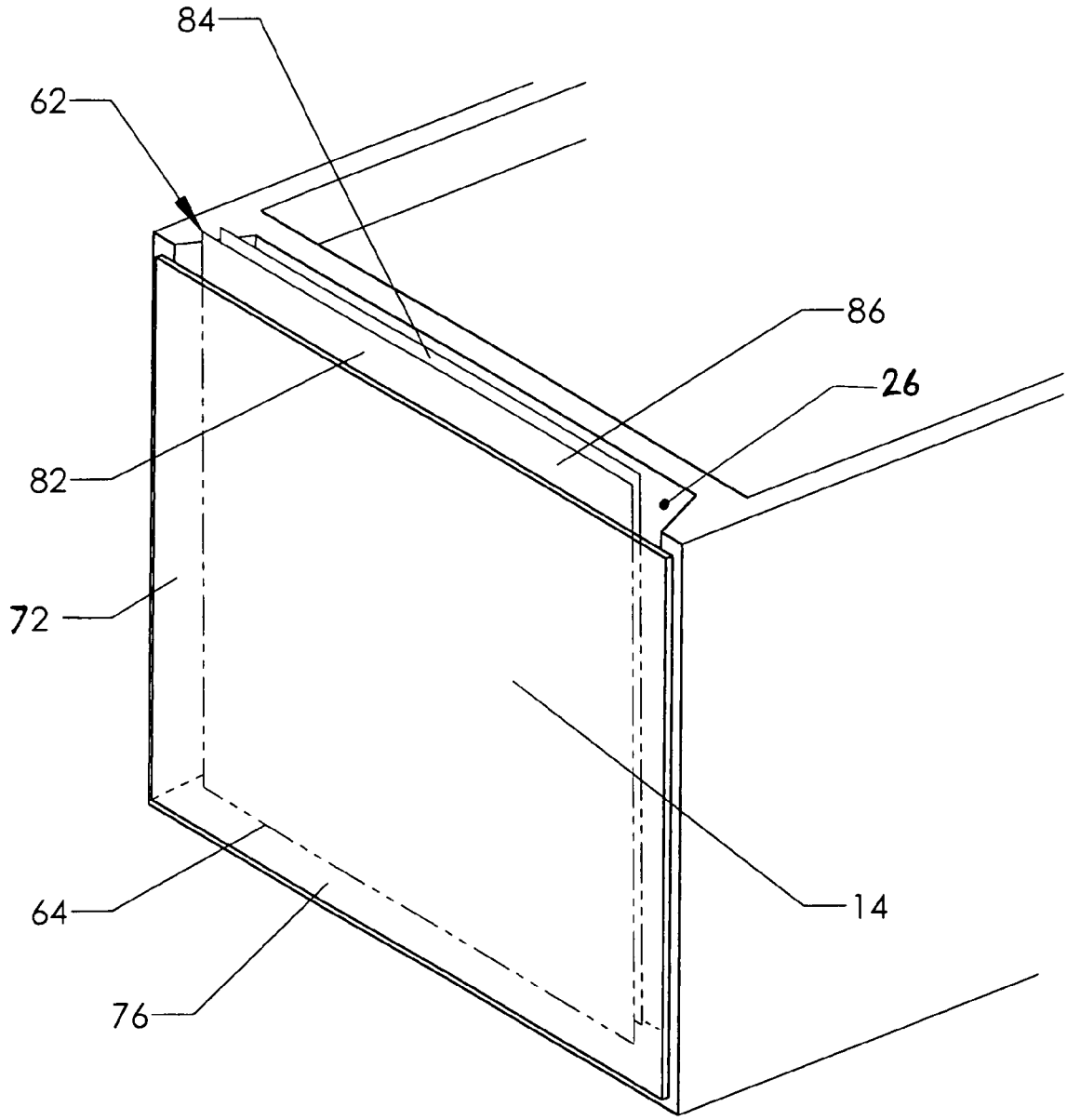
FIG. 7 is a perspective view, showing the insertion of sleeve into the pocket of the present invention.
Figure 8:
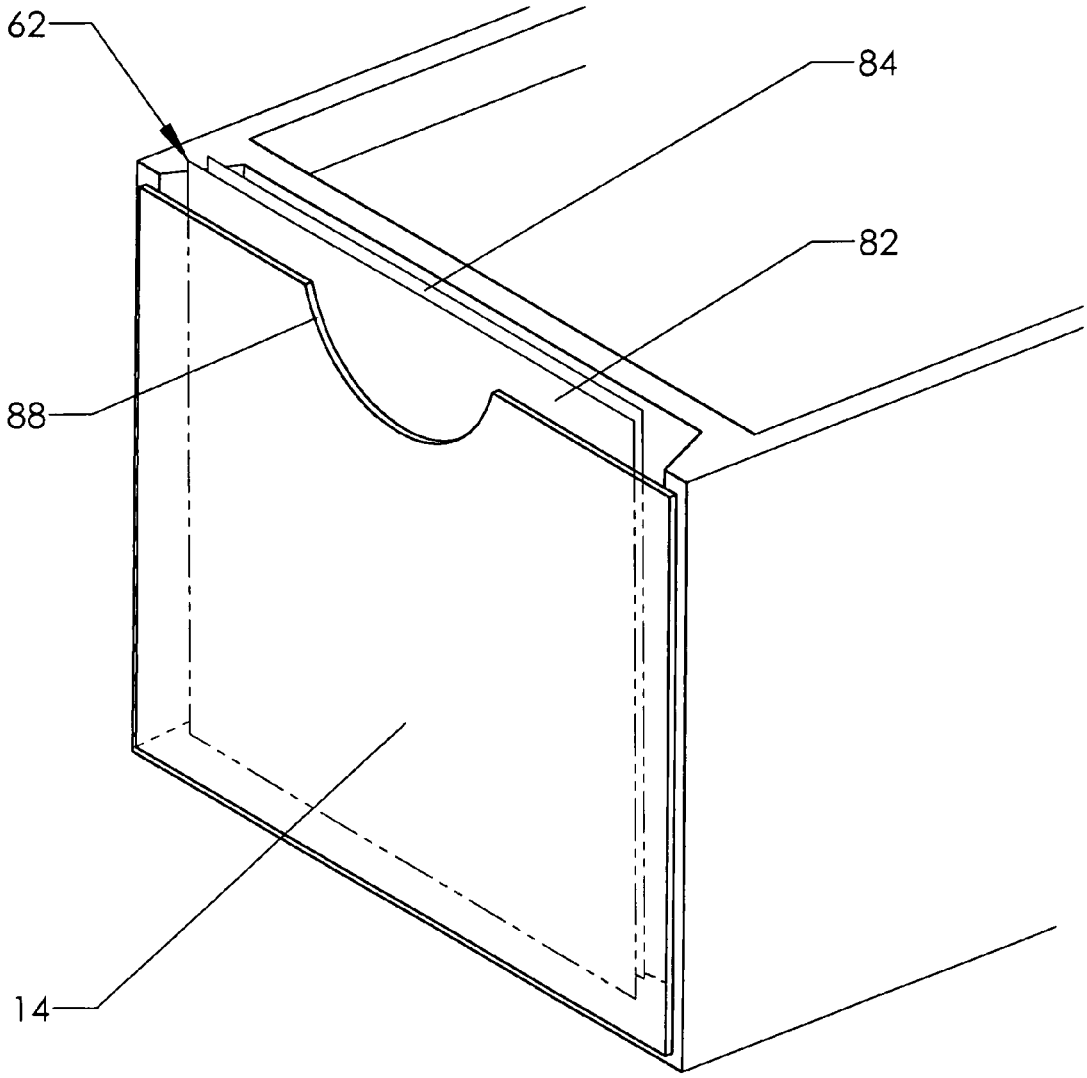
FIG. 8 is a perspective view, showing an alternate embodiment of the present invention.

FIG. 7 illustrates the placement of sleeve 62 inside of pocket 26. Front cover 82 and back cover 84 are such a height that when fold 64 contacts third interior wall 76 at the deepest part of pocket 26, both front cover 82 and back cover 84 protrude out of the top of pocket 26, creating tab 86. Tab 86 can be easily grasped by a user in order to simply and quickly change or adjust a display article. When pulling sleeve 62 from pocket 26, fold 64 prevents a display article from slipping back into pocket 26. In an alternate embodiment, shown in FIG. 8, sleeve 62 is accessed through notch 88. Like tab 86, notch 88, allows a user to grasp and remove sleeve 62 thereby making it simpler and quicker to change or adjust a display article.

Figure 9:
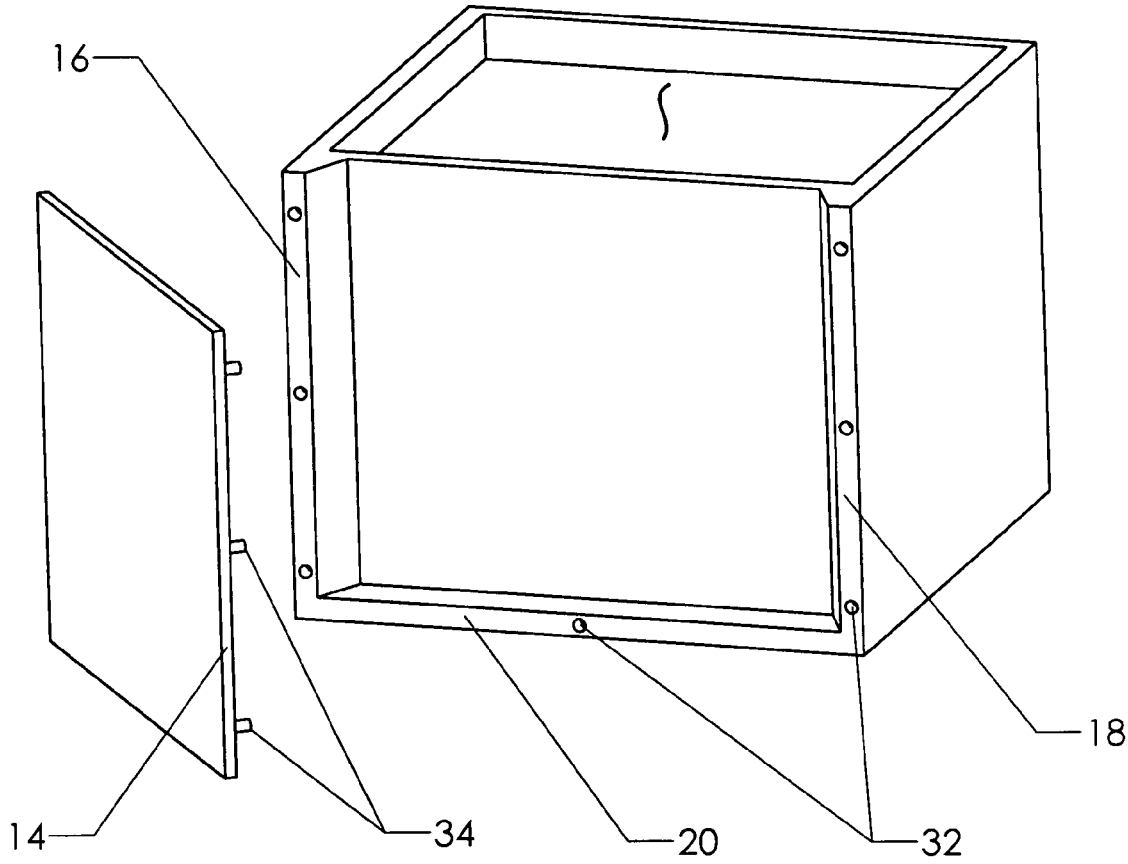
FIG. 9 is a perspective view, showing an alternate embodiment of the present invention.

FIG. 9 illustrates an alternate embodiment of the present invention. In this embodiment, spacers 16, 18, and 20 have mounting bores 32 which are blind holes bored into the spacers. Mounting bores 32 are sized to receive mounting studs 34 which are attached to display panel 14. Other mechanical fasteners such as screws or rivets may also be used to attach display panel to spacers 16, 18, and 20. Contact adhesive may be used in addition to the mechanical fasteners. For example, contact adhesive may be injected into mounting bores 32 to prevent display panel from separating from the candle container.

Figure 10:
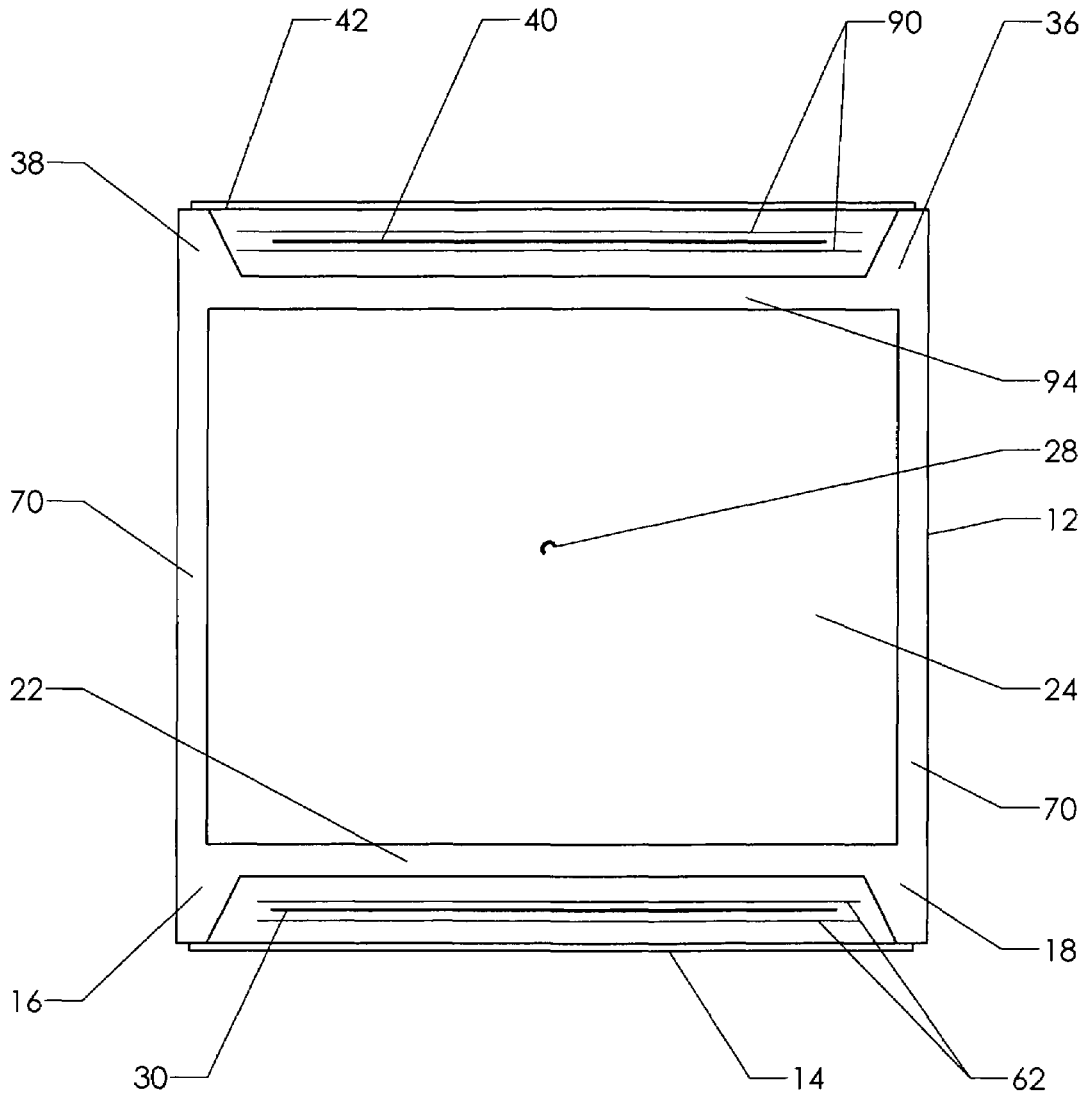
FIG. 10 is a top view, showing an alternate embodiment of the present invention.

An alternate embodiment of the present invention is illustrated in FIG. 10. In this embodiment, display panels, 42 and 14 are provided on both sides of candle container 12 to allow multiple display articles to be shown. Spacers 36 and 38 extend away from candle container 12 on the side of candle container 12 opposite of spacers 16 and 18. Display panel 42 is attached to spacers 36 and 38. Sleeve 62 is then inserted into the pocket formed by candle container 12, spacers 36 and 38, and display panel 42.

Figure 11:
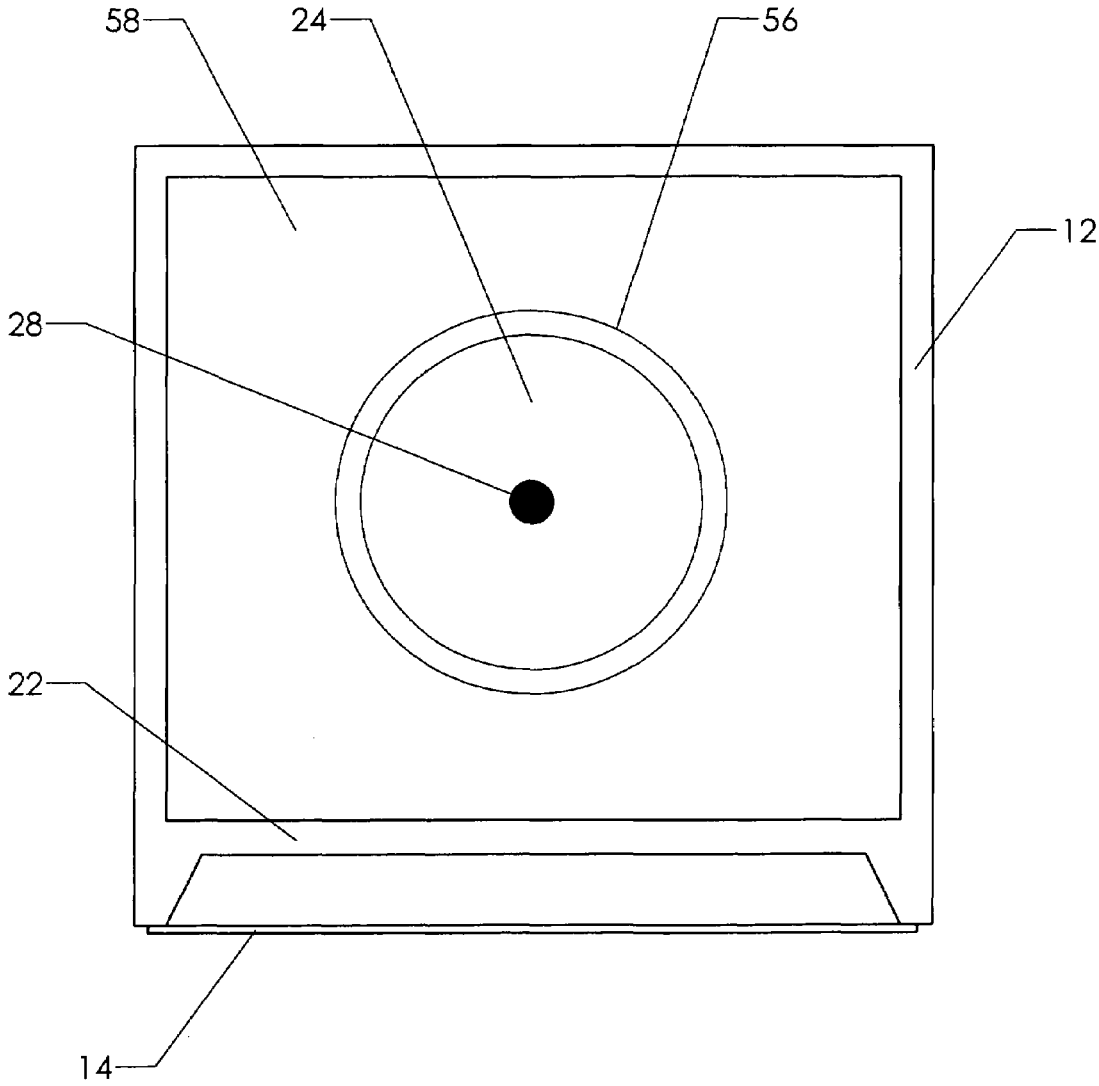
FIG. 11 is a top view, showing an alternate embodiment of the present invention.
Figure 12:
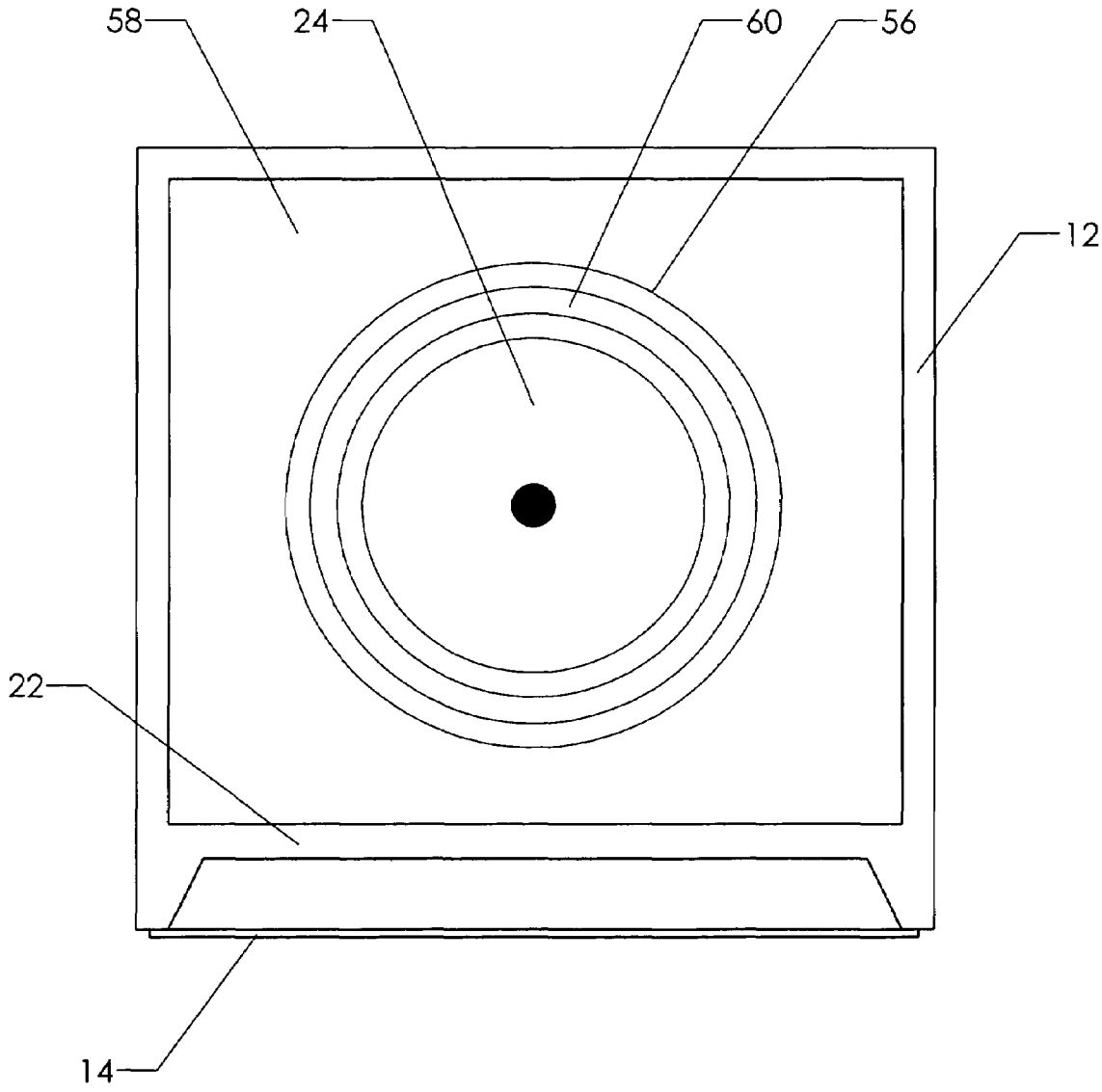
FIG. 12 is a top view, showing an alternate embodiment of the present invention.

As shown in FIG. 11, the display device may be further improved by providing wall 56 within candle container 12 to separate candle 24 from matrix 58. Wall 56 is a clear vertical cylinder. It may be made of glass, polycarbonate or other material capable of withstanding the heat produced when burning candle 24. Matrix 58 is preferably a clear gel that dispenses a volatile fragrance when candle 24 is lit. Matrix 58 may also contain decorative objects such as flower petals, colored glass or beads. As a further improvement of the embodiment of FIG. 11, candle 24 may be provided in inner container 60 to allow for easy replacement when candle 24 is completely consumed as shown in FIG. 12. If inner container 60 is not used, residue from candle 24 would remain within wall 56 after candle 24 is consumed. In such a case, the residue must be scraped out of the region enclosed by wall 56 before a replacement candle is placed within wall 56. However, using the embodiment of FIG. 12, inner container 60 may be easily removed from candle container 12 and a replacement candle and container may be inserted in its place. This allows the display device to be used even after the original candle is completely consumed.

The preceding description contains significant detail regarding the novel aspects of the present invention. It is should not be construed, however, as limiting the scope of the invention but rather as providing illustrations of the preferred embodiments of the invention. For example, candle container 12 may assume various angular or curvilinear cross-sectional shapes. Candle container 12 need not have a cross-section in the shape of a square. Thus, the scope of the invention should therefore be fixed by the following claims, rather than by the examples given.

Having described my invention, I claim:

1. A display device, for use by a user, comprising:

a. a candle, said candle having a wick;

b. a container, said container surrounding said candle having an inside wall;

c. a first spacer, a second spacer and a third spacer attached to said inside wall;

d. wherein said first spacer has a first interior wall;

e. wherein said second spacer has a second interior wall;

f. wherein said third spacer has a third interior wall;

g. wherein said first spacer, said second spacer and said third spacer form a stand-off;

h. a display panel, said display panel attached to said stand-off;

i. wherein said stand-off separates said inside wall and said display panel;

j. wherein said display panel, said first interior wall, said second interior wall, said third interior wall and said inside wall form a pocket;

k. a display article, said display article having a first side and a second side, said display article positioned in said pocket such that said first side faces said inside wall and said second side faces said display panel, said display article further positioned such that when said candle is lit, candlelight passes through said inside wall, strikes said first side of said display article thereby creating a backlit effect on said display article which is viewable through said display panel.

2. The display device of claim 1, wherein said display device further comprises:

a. a sleeve, said sleeve having a front cover and a back cover;

b. wherein said sleeve is positioned in said pocket such that said back cover faces said inside wall and said front cover faces said display panel.

3. The display device of claim 2, wherein said sleeve further comprises a first fold, wherein said first fold is positioned in said pocket such that said first fold contacts said third interior wall.

4. The display device of claim 3, wherein sleeve further comprises a tab, wherein when said fold of said sleeve contacts said third interior wall, said tab protrudes out of said pocket.

5. The display device of claim 3, wherein said sleeve is configured to accept said display article between said front cover and said back cover of said sleeve.

6. The display device of claim 3, wherein said sleeve further comprises a second fold, wherein said second fold is positioned at the opposite end of said sleeve than said first fold.

7. The display device of claim 6, wherein said sleeve is configured to accept said display article between said front cover and said back cover of said sleeve.

8. The display device of claim 3, wherein said sleeve comprises a clear material.

9. The display device of claim 2, wherein said display panel further comprises a notch, wherein said notch is positioned to allow said user to slide said sleeve out of said pocket.

10. The display device of claim 1, wherein said candle comprises a clear material.

11. The display device of claim 1, wherein said container comprises a clear material.

12. The display device of claim 1, wherein said stand-off comprises a clear material.

13. The display device of claim 1, said candle container containing a clear gel matrix.

14. The display device of claim 13, further comprising an inside wall within said container, said inside wall separating said candle from said clear gel matrix.

15. The display device of claim 14, further comprising an inner container surrounding said candle, said inner container situated within said inside wall.

16. The display device of claim 1, wherein said first display panel is bonded to said stand-off with a contact adhesive.

17. The display device of claim 1, wherein said first display panel is attached to said first stand-off by a mechanical fastener.

18. The display device of claim 1, wherein said container includes a second inside wall, said display device further comprising:

a. a second stand-off, said second stand-off attached to said second inside wall of said container;

b. a second display panel, said second display panel attached to said second stand-off;

c. a second pocket, formed by said second stand-off, said second inside wall of said container, and said second display panel;

d. a second sleeve, said second sleeve having a front cover and a back cover, said second sleeve positioned in said second pocket; and e. a second display article, said second display article having a first side and a second side, said second display article positioned between said front cover and said back cover of said second sleeve such that said first side faces said back cover and said second inside wall and said second side faces said front cover and said second display panel, said second display article further positioned to be viewable through said second display panel.

19. The display device of claim 18, wherein said second display article is sealed and completely enclosed in said second pocket.

20. A display device, for use by a user, comprising:

a. a candle, said candle having a wick;

b. a container, said container surrounding said candle having an inside wall;

c. a first spacer, a second spacer and a third spacer attached to said inside wall;

d. wherein said first spacer has a first interior wall;

e. wherein said second spacer has a second interior wall;

f. wherein said third spacer has a third interior wall;

g. wherein said first spacer, said second spacer and said third spacer form a stand-off;

h. a display panel, said display panel attached to said stand-off;

i. wherein said display panel, said first interior wall, said second interior wall, said third interior wall and said inside wall form a pocket;

j. a sleeve, said sleeve having a front cover and a back cover;

k. wherein said sleeve is positioned in said pocket such that said back cover faces said inside wall and said front cover faces said display panel; and l. a display article, said display article having a first side and a second side, said display article positioned in said sleeve such that said first side faces said back cover and said second side faces said front cover, said display article further positioned such that when said candle is lit, candlelight passes through said inside wall, said back cover of said sleeve and strikes said first side of said display article thereby creating a backlit effect on said display article which is viewable through said display panel.

21. The display device of claim 20, wherein said sleeve further comprises a first fold, wherein said first fold is positioned in said pocket such that said first fold contacts said third interior wall.

* * * * *